US005609475A

United States Patent [19]

Eiermann

[11] Patent Number: 5,609,475

[45] Date of Patent: Mar. 11, 1997

[54] COMPRESSOR WITH A HYPOTROCHOIDAL DESIGN HAVING A FLUID DELIVERY WHICH IS NOT SOLELY DEPENDENT ON A DRIVE RPM

[75] Inventor: Dankwart Eiermann, Weissensberg, Germany

[73] Assignee: Wankel Rotary GmbH, Korb, Germany

[21] Appl. No.: 547,334

[22] Filed: Oct. 24, 1995

[51] Int. Cl.[6] ..... F04B 49/00

[52] U.S. Cl. ..... 417/294; 417/293; 418/41; 418/185

[58] Field of Search ..... 417/293, 294, 417/410.3; 418/185, 188, 41, 42, 61.3

[56] References Cited

U.S. PATENT DOCUMENTS

| | | | |
|---|---|---|---|
| 2,247,410 | 7/1941 | Ross | 418/185 |
| 2,586,968 | 2/1952 | Maclay | 418/43 |
| 2,825,290 | 3/1958 | Bakker | 417/76 |
| 3,029,738 | 4/1962 | Clar | 418/159 |
| 3,191,541 | 6/1965 | Brown | 418/188 |
| 3,656,876 | 4/1972 | Kochner | 418/185 |
| 3,749,530 | 7/1973 | Amador | 418/41 |
| 3,986,487 | 10/1976 | Yanai | 417/294 |
| 4,108,130 | 8/1978 | Bailey | 417/294 |

*Primary Examiner*—Timothy Thorpe
*Assistant Examiner*—Peter G. Korytnyk
*Attorney, Agent, or Firm*—Evenson, McKeown, Edwards & Lenahan, P.L.L.C.

[57] ABSTRACT

A compressor with a hypotrochoidal design is constructed in such fashion that its delivery can be varied in ways other than by the drive rpm alone. A controlling edge of an inlet opening that determines the beginning of compression has a variable angular position for this purpose.

12 Claims, 2 Drawing Sheets

COMPRESSOR WITH A HYPOTROCHOIDAL DESIGN HAVING A FLUID DELIVERY WHICH IS NOT SOLELY DEPENDENT ON A DRIVE RPM

BACKGROUND AND SUMMARY OF THE INVENTION

The invention relates to a compressor with a hypotrochoidal design having a rotor housing in which a circular piston rotor circulates. The compressor is mounted on a hollow eccentric shaft that is provided with an inlet opening limited in the circumferential direction by a control edge that runs essentially in the axial direction and determines the beginning of intake and the beginning of compression. Radial intake ducts of the circular piston rotor are associated with the opening. The radial intake ducts terminate in chambers formed between the circular piston rotor and the rotor housing. The rotor housing is provided in the vicinity of these chambers with outlet openings controlled by pressure valves.

A known compressor of the above-mentioned type has been used previously as an air pump. Its delivery is directly dependent upon the drive rpm at which the eccentric shaft is driven. High drive rpm values result in a correspondingly high delivery, while low drive rpm values produce a correspondingly low delivery.

Similar behavior has been exhibited by formerly conventional coolant compressors, in which the delivery of coolant was likewise directly dependent on the drive rpm, i.e. the current engine rpm. Since this direct dependence is unsatisfactory for both driving comfort and for the efficiency of an air conditioner in a motor vehicle, the motor vehicle industry now requires that delivery in coolant compressors be variable independently of the current drive rpm, e.g. that it remain constant while the rpm changes. In practice, this behavior can be achieved only in swashplate reciprocating compressors in which, by virtue of different diagonal positions of the swashplate, the piston travel and hence the delivery or throughput can be varied.

There is therefore needed a compressor with a hypotrochoidal design constructed such that its delivery does not depend solely on the drive rpm but can be kept constant or varied independently of the drive rpm.

These needs are achieved by providing a device for changing, in the circumferential direction, the angular position of the controlling edge of the inlet opening of the eccentric shaft that determines the beginning of compression for the compressor.

This design makes it possible, by changing the angular position of the controlling edge that determines the beginning of compression, to change the degree of filling of the individual chambers so that the delivery or throughput is changed as well. It can be expected that such a compressor with a hypotrochoidal design has considerable advantages over known swashplate reciprocating compressors with variable swashplate positions, since no reciprocating masses are required so that much higher rpm values are possible, and manufacture is cheaper.

In another embodiment of the present invention, the compressor is provided with a device, independent of the rpm of the eccentric shaft, for changing the angular position of the controlling edge of the inlet opening that determines the beginning of compression. In this way, the delivery of the compressor can be regulated in such fashion that it remains constant regardless of the rpm.

In one advantageous embodiment, the inlet opening is subdivided in the axial direction into two sections, one of which is provided in the eccentric shaft while the other is located in a sleeve that is mounted to rotate freely in the circumferential direction on the eccentric shaft. By rotating this, sleeve relative to the eccentric shaft, the angular position of the control edge that determines the beginning of compression can be changed relatively easily.

Other objects, advantages and novel features of the present invention will become apparent from the following detailed description of the invention when considered in conjunction with the accompanying drawings.

DETAILED DESCRIPTION OF THE DRAWINGS

Figure 1:
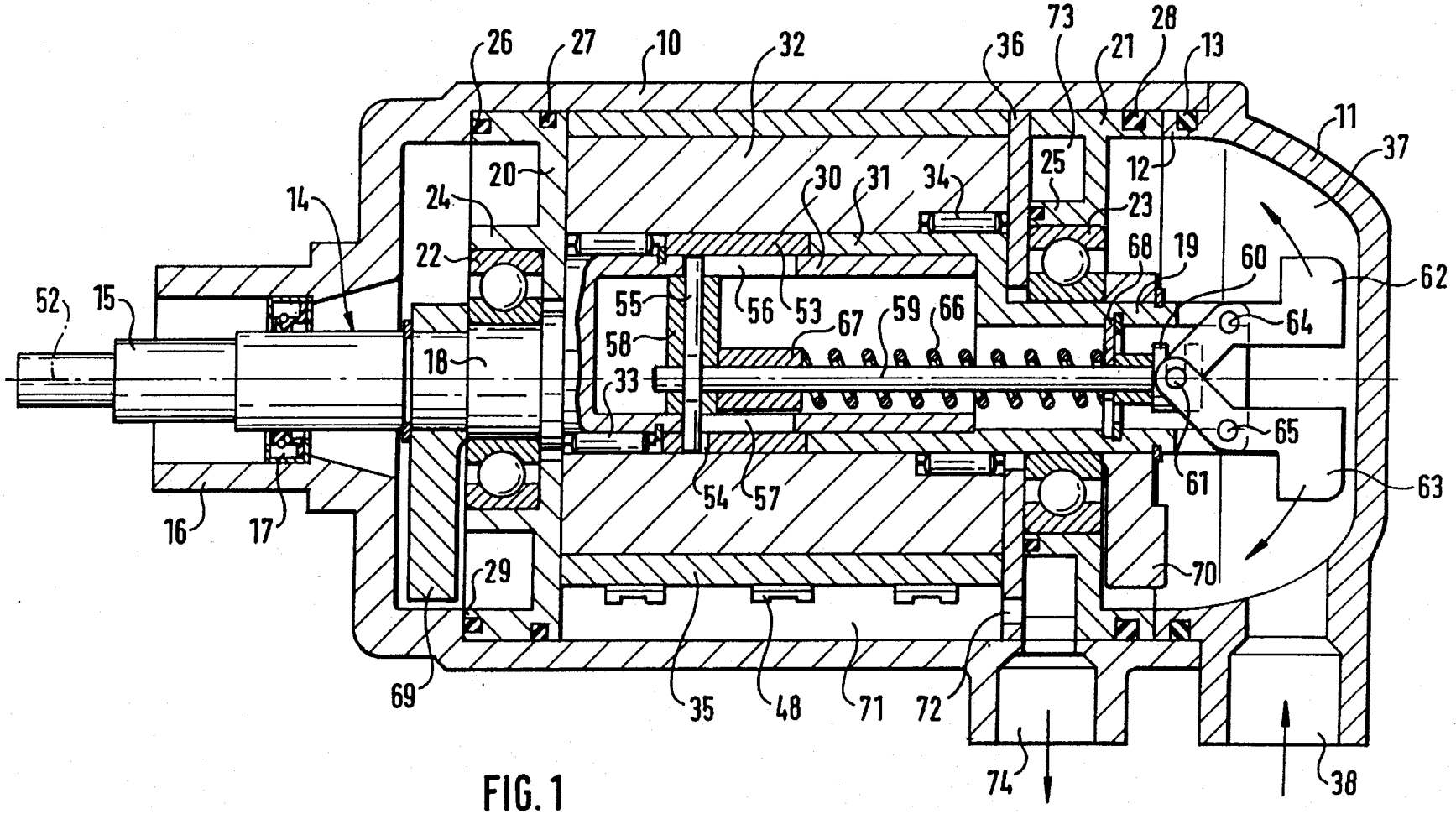
FIG. 1 is an axial section view through a compressor for a coolant according to the present invention.

The compressor with a hypotrochoidal design, shown in FIG. 1, possesses a pot-shaped external housing 10 having an open side closed by a lid 11. The lid 11 projects with a collar 12 into the cylindrical housing 10.

Collar 12 is provided with an inserted sealing ring 13. An eccentric shaft 14 is mounted in housing 10, the driving end 15 of the shaft 14 extending out of a collar 16 in the bottom of housing 10. Eccentric shaft 14 is externally sealed in the collar-shaped projection 16 by a commercial shaft seal 17, especially a sliding ring seal.

The eccentric shaft 14 is assembled from two parts. Each of these parts has a central shaft bearing pin 18, 19 by which the eccentric shaft 14 is mounted in two lateral parts 20, 21. The shaft bearing pins 18, 19 are each mounted via a roller bearing 22, 23 in bearing seats 24, 25 of the lateral parts 20, 21. The lateral parts 20, 21 have a disk-shaped and are inserted into an axial recess in the housing 10 and are sealed-off from the latter by sealing rings 26, 27, 28. The lateral part 20 abuts a shoulder 29 in the axial direction in the housing 10.

Figure 2:
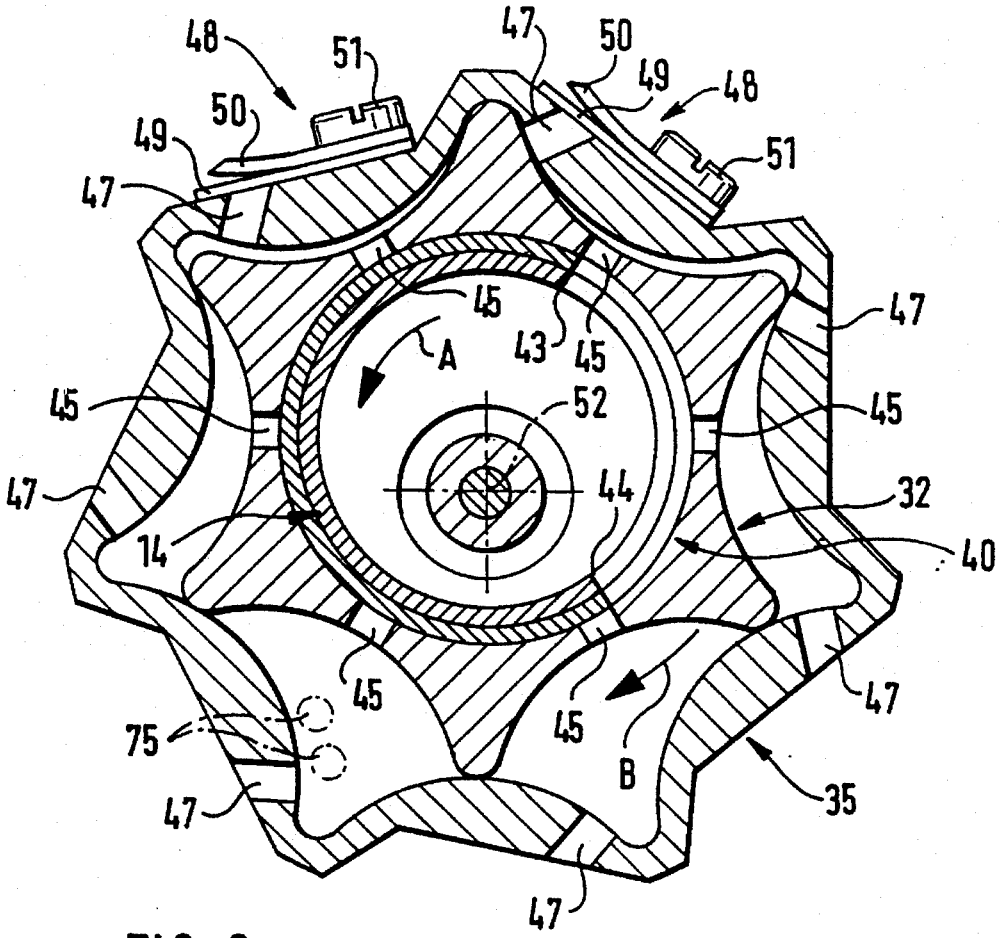
FIG. 2 is a partial radial section view through the compressor in FIG. 1.

Between the shaft bearing pins 18, 19, the two parts of the eccentric shaft 14 are each provided with a cylindrical sleeve-shaped projection 30, 31 located eccentrically with respect to the shaft bearing pins 18, 19. The sleeve-shaped part 30 is inserted into the sleeve-shaped part 31 and connects with the latter by a press fit. A circular piston rotor 32 is rotatably mounted on the two sleeve-shaped parts 30, 31 by means of roller bearings 33, 34, preferably needle bearings, so that the two sleeve-shaped projections 30, 31 form eccentric bearing seats. The circular piston rotor 32, whose shape is shown in FIG. 2, runs in a rotor housing 35 whose internal contour is likewise evident from FIG. 2. Circular piston rotor 32 and rotor housing 35 form a circular piston machine of the hypotrochoidal design (Classification Location KIII-5 "Classification of rotary piston machines", F. Wankel). Rotor housing 35 is held stationary in housing 10 between the lateral disks 20, 21. A plate 36 is located between the lateral plate 21 and the rotor housing 35. The plate 36 is abutted on one side by the rotor housing 35 and on the other side by the lateral disk 21. The assembly composed of the eccentric shaft 14, the lateral disks 20, 21, the plate 36, the circular piston rotor 32, and the rotor housing 35 is preassembled as a module that is inserted from the open side into the housing 10 and then is held in place by the lid 11. The lid 11 is fastened to the housing 10 in a manner not shown in greater detail through the use of clamping screws.

Figure 3:
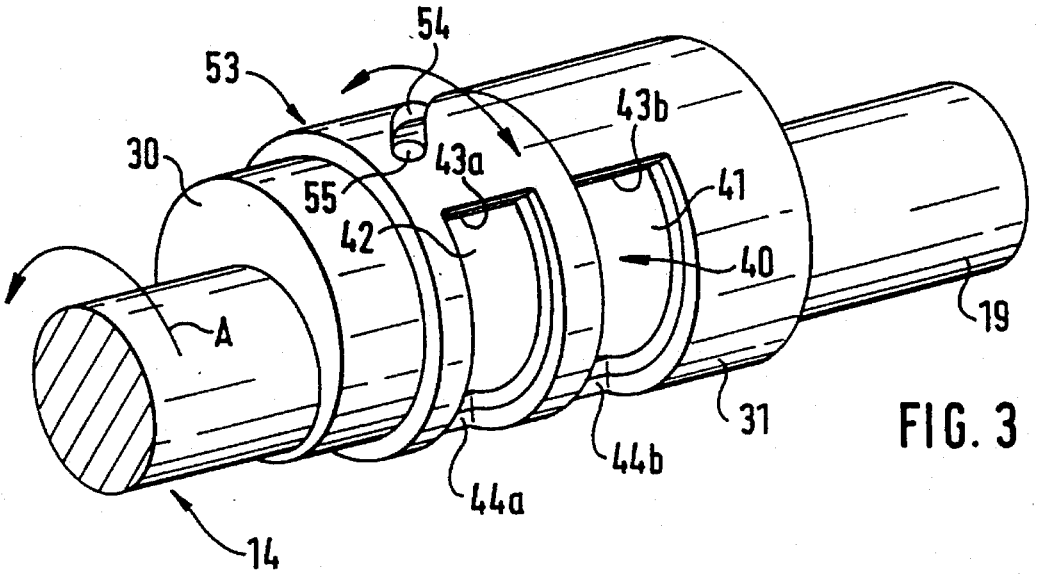
FIG. 3 is a perspective view of a portion of the eccentric shaft of the compressor according to FIG. 1 in the vicinity of a variable inlet opening.

Shaft bearing pin 19 is hollow and forms a connection between the interior of the eccentric projections 30, 31 of the eccentric shaft and an intake chamber 37 in the vicinity of the lid 11. This suction chamber 37 is provided with an intake connection 38. Referring to FIGS. 2 and 3, the eccentric projections 30, 31 of the eccentric shaft are provided with an inlet opening 40 delimited in the circumferential direction by control edges 43, 44. Inlet opening 40 is associated with suction channels 45 of the circular piston rotor 32. The channels 45 periodically connect the intake opening 40 with the chambers formed between the circular piston rotor 32 and the rotor housing 35. Rotor housing 35, with the interior shape of a 7:6 reduced hypotrochoid, has in the leading corners, as viewed in the rotational direction A of eccentric shaft 14, outlet openings with which pressure valves 48 are associated. The pressure valves 48 consist of a flexible valve plate 49 and a stroke limiter 50 jointly fastened by a screw 51. Outlet openings 47 with the pressure valves 48 are provided in the vicinity of each of the leading corners, and are not shown in FIG. 2 for the sake of simplicity.

When the eccentric shaft 14 rotates around the central axis 52 in the direction of arrow A, the circular piston rotor 32 rolls in the rotor housing 35 like a gear, with its rotational direction B being opposite the rotational direction A of the eccentric shaft 14. With each rotation of the eccentric shaft 14, all of the chambers change their volumes once from a minimum to a maximum and back again to a minimum. Inlet opening 40 is designed in such fashion, i.e. the angular positions of control edges 43, 44 are so set, that when the volumes increase, it opens the connection to intake ducts 45, and blocks this connection when the volume is decreased. As a result, intake occurs during enlargement of the volumes and compression occurs during reduction of the volumes. Pressure valves 48 therefore, by virtue of their design, determine the maximum compression pressure. The medium transported by the compressor passes through the pressure valves 48 into the pressure channels 71 provided between the circumference of the rotor housing 35 and the housing 10. The adjoining plate 36 is provided with openings 72 associated with these pressure channels 71, so that the compressed medium flows into an annular channel 73 formed by the side part 21. The housing 10 is provided in the vicinity of this annular channel 73 with a pressure connection 74 that communicates through an opening with the annular channel 73.

In order to ensure that the delivery or throughput of the compressor described above does not depend exclusively on the rpm of the eccentric shaft and hence on the rpm of a drive motor, provision is made such that the angular position of the control edge 44, which determines the beginning of compression, is variable. If the angular position of control edge 44 is displaced backward and hence opposite rotational direction A, the connection between the intake opening 40 and the intake channel 45 of the chambers remains open over a larger angular distance and hence for a longer time, so that reduction of the volumes of the chambers begins without any compression taking place. The degree of filling of the chambers is thus reduced so that delivery is correspondingly reduced. In extreme cases, control edge 44 can be moved backward and hence opposite rotational direction A to the point where no delivery occurs at all.

The change in the angular position of control edge 44 of intake opening 40 is explained in greater detail with reference to the drawing in FIG. 3. As is evident from FIG. 3, intake opening 40 is divided into two sections 41, 42 that adjoin in the axial direction. Section 41 is provided in the eccentric projections 30, 31 of eccentric shaft 14. It extends in the axial direction beyond section 42 which is part of a sleeve 53 rotatably mounted on the eccentric projection 30. Section 41 is thus stationary with respect to the eccentric projections 30, 31, while section 42 is rotatable in the circumferential direction. Control edge 43 consists of a control edge **43*a* of section 42 and a control edge 43*b* of section 41. When sleeve 53 rotates in a direction opposite the rotational direction A of the eccentric shaft 14, the control edge 43*b* determines the beginning of the intake as before. The change in angular position of the control edge 43*a* has no effect on this. The control edge 44 correspondingly consists of the control edge 44*a* of section 42 of sleeve 43 and the control edge 44*b* of section 41. The angular position of the control edge 44*a* determines the beginning of compression when it does not, as shown in FIGS. 2 and 3, coincide with the angular position of the control edge 44*b***.

The rotation of sleeve 53 and hence the change in the angular position of the control edge **44*a* is accomplished by an adjusting device shown in FIG. 1. This adjusting device is primarily rpm-dependent, i.e. as the rpm increases the angular position of the control edge 44*a* is displaced in a direction opposite the rotational direction A of the eccentric shaft 14, so that the beginning of compression is delayed. In this manner it is possible with the aid of a suitable design to keep the delivery constant independently of the drive rpm. Sleeve 53 located on eccentric projection 30, which axially abuts the end of projection 31 and is held in place by a snap ring, is provided with a slot 54 that runs at an angle to the lengthwise axis, in which slot a pin 55 engages. The pin 55 is guided in two axial slots 56, 57 of the projection 30. Pin 55 located in a guide part 58 engages an eye of a connecting rod 59. The other end of the connecting rod 59 is provided with a fork-shaped end piece 60 into which the dogs 61 of flyweights 62, 63 engage. The flyweights 62, 63 are pivotable around axes 64, 65. The axes are located in the end of the shaft bearing pin 19 of the eccentric shaft 14. The connecting rod 59 is surrounded by a pretensioned return spring 66 located between a guide sleeve 67 that surrounds the connecting rod 59 and abuts the guide part 58 and a ring 68 provided with recesses having a large area. The ring 68 is held via a snap ring inside the shaft bearing pin 19**.

The flyweights 62, 63 that rotate together with the eccentric shaft 14 urge the pin 55 against the action of the return spring with a force that depends upon the rpm of the eccentric shaft 14. The design of the flyweights 62, 63 and the return spring 66 is such that the pin 55 is displaced in the axial direction in such manner that it moves the sleeve 53 in the circumferential direction in such fashion that even with changing rpm, a delivery from the compressor that is as constant as possible is achieved.

The eccentric shaft 14 is weighted by balancing disks 69, 70 mounted on the shaft bearing pins 18, 19.

In a modified embodiment, the connecting rod 59 is brought out of the interior of the housing and an external adjusting control or adjusting regulator engages the connecting rod 59. In this case it is possible to eliminate the flyweights 62, 63 and/or to superimpose an additional adjusting function on the adjustment using the flyweights 62, 63.

In the embodiment shown, the intake opening 38 and the pressure connection 74 are arranged radially. Of course, it is also possible to provide axially directed connections in the vicinity of the lid 11 so that a connection must be provided in such a lid between its pressure connection and intake channels 71.

In another modified embodiment, instead of the outlet openings 47 of the rotor housing 35 that are essentially radial, outlet openings are provided, as indicated by the dashed lines in FIG. 2, in the lateral part 20 and the plate 36, which are then likewise provided with pressure valves 48.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Compressor of hypotrochoidal design with a rotor housing in which a circular piston rotor rotates, said circular piston rotor being mounted on a hollow eccentric shaft provided with an intake opening delimited in a circumferential direction by control edges that primarily in an axial direction and determine a beginning of intake and a beginning of compression, said control edges corresponding with radial intake channels of the circular piston rotor that terminate in chambers formed between the circular piston rotor and the rotor housing, with the rotor housing being provided in a vicinity of said chambers with outlet openings controlled by pressure valves, wherein a control edge angular position device changes in the circumferential direction and angular position of at least one of said control edges of said intake opening of the eccentric shaft that determines the beginning of compression.

2. Compressor according to claim 1, wherein the control edge angular position device comprises means, dependent on an rpm of the eccentric shaft, for changing the angular position of the one control edge of the intake opening that determines the beginning of compression.

3. Compressor according to claim 1, wherein said intake opening is divided in the axial direction into two sections, one section being provided in the eccentric shaft while the other section is provided in a sleeve mounted to rotate freely in the circumferential direction on the eccentric shaft.

4. Compressor according to claim 3, wherein said sleeve is rotatable via an adjusting device located inside the eccentric shaft.

5. Compressor according to claim 4, wherein said adjusting device comprises flyweights that rotate together with the eccentric shaft, said flyweights engaging said sleeve via a transmission mechanism that comprises a return spring.

6. Compressor according to claim 5, wherein said transmission mechanism comprises an axially displaceable rod provided with a pin displaceably guided in the axial direction in the eccentric shaft and engaging a guide slot in the sleeve that runs diagonally with respect to the lengthwise axis.

7. Compressor according to claim 6, wherein said flyweights are mounted on the eccentric shaft, said flyweights being connected with said axially displaceable rod.

8. Compressor according to claim 1, wherein said eccentric shaft, the circular piston rotor and the rotor housing are located in a housing that is sealed pressure-tight except for an intake connection, a pressure connection, and an entrance for the eccentric shaft, and further where a shaft seal for the eccentric shaft is provided in the vicinity of the entrance.

9. Compressor according to claim 8, wherein said intake connection is connected by a sealed flow path with an open end of the hollow eccentric shaft, and wherein said pressure connection is connected by a sealed flow path with the rotor housing.

10. Compressor according to claim 1, wherein said eccentric shaft is assembled from two parts each having a central shaft bearing pin and an eccentric bearing seat for the circular piston rotor, with the areas of the eccentric bearing seats being made hollow and inserted into one another.

11. Compressor according to claim 1, wherein the chambers have leading corners, and wherein outlet openings are located in the vicinity of said leading corners.

12. Compressor according to claim 1, wherein outlet parts are provided to axially cover the circular piston rotor, and wherein outlet openings are located inside said parts.

* * * * *